US009913778B2

(12) United States Patent
Dvorak et al.

(10) Patent No.: US 9,913,778 B2
(45) Date of Patent: Mar. 13, 2018

(54) PRESCRIPTION MEDICATION SECURITY AND DISPENSING SYSTEMS

(71) Applicants: Sheri Dvorak, Scottsdale, AZ (US); Steven S Borick, Tempe, AZ (US)

(72) Inventors: Sheri Dvorak, Scottsdale, AZ (US); Steven S Borick, Tempe, AZ (US)

( * ) Notice: Subject to any disclaimer, the term of this patent is extended or adjusted under 35 U.S.C. 154(b) by 624 days.

(21) Appl. No.: 14/610,392

(22) Filed: Jan. 30, 2015

(65) Prior Publication Data

US 2016/0158107 A1 Jun. 9, 2016

Related U.S. Application Data

(63) Continuation-in-part of application No. 14/561,998, filed on Dec. 5, 2014, now abandoned.

(51) Int. Cl.

| | |
|---|---|
| ***B02C 25/00*** | (2006.01) |
| ***A61J 7/00*** | (2006.01) |
| ***B02C 19/08*** | (2006.01) |
| ***A61J 1/14*** | (2006.01) |
| *A61J 7/04* | (2006.01) |

(52) U.S. Cl.

CPC ..... *A61J 7/0007* (2013.01); *A61J 1/1437* (2013.01); *A61J 7/0084* (2013.01); *B02C 19/08* (2013.01); *B02C 25/00* (2013.01); *A61J 7/0445* (2015.05); *A61J 2200/70* (2013.01)

(58) Field of Classification Search

CPC ..... A61J 7/0007; B02C 25/00
USPC ..... 241/DIG. 27
See application file for complete search history.

(56) References Cited

U.S. PATENT DOCUMENTS

| | | | | |
|---|---|---|---|---|
| 4,905,916 | A * | 3/1990 | Sorwick | B02C 19/0075 241/23 |
| 5,046,669 | A * | 9/1991 | Wallace | A61M 5/3278 241/23 |
| 6,415,202 | B1 | 7/2002 | Halfacre | |
| 7,673,825 | B2 * | 3/2010 | Jeansonne | B02C 18/142 241/100 |
| 8,376,256 | B1 * | 2/2013 | Ferguson | B02C 1/00 241/169.2 |
| 2003/0168538 | A1 * | 9/2003 | Dobson | A61J 3/002 241/21 |
| 2004/0191275 | A1 * | 9/2004 | Milner | B01F 1/0005 424/400 |
| 2010/0228141 | A1 | 9/2010 | Kountotsis | |
| 2014/0074283 | A1 | 3/2014 | Blackburn | |
| 2016/0235628 | A1 * | 8/2016 | Zelikman | A61J 3/00 |

* cited by examiner

*Primary Examiner* — Faye Francis
(74) *Attorney, Agent, or Firm* — Integrity Patent Group, PLC; Edwin Wold

(57) ABSTRACT

A prescription drug monitoring/dispensing device ensures prescription medication housed within is taken only as directed, and not abused or sold on the streets. The device serves as an intricately guarded casing that may only dispense the preprogrammed dosage amounts at preset times, as directed by a prescribing physician. The device may include a housing having a biometric finger scanner and a display screen in communication therewith, a loading tube capable of holding a pill therein, a rotating hub in communication with the loading tube, a rotating disc in communication with the loading tube, and an exit port capable of dispensing the pill out from the housing.

19 Claims, 9 Drawing Sheets

PRESCRIPTION MEDICATION SECURITY AND DISPENSING SYSTEMS

CROSS-REFERENCE TO RELATED APPLICATION

The present application is a Continuation-in-Part (CIP) related to and claims priority from prior provisional application Ser. No. 61/912,034, filed Dec. 5, 2013 and pending non-provisional application Ser. No. 14/561,998 filed Dec. 5, 2014 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of prescription medication dispensing devices and more specifically relates to a tamper-proof prescription medication dispensing device having a drug disabling chamber for destroying the prescription medication contained within the device if the device is tampered with by an unauthorized user.

2. Description of the Related Art

According to information provided by the National Institute of Health (NIH), nearly 20 percent of people in the United States have used prescription drugs for non-medical reasons. In fact, prescription drugs are the second most commonly abused category of drugs (marijuana is first), far ahead of cocaine, heroin, and even methamphetamine. A dangerous practice, this abuse resulted in approximately 43 percent of hospital emergency admissions for drug overdoses in 2010. Further, the number of teens and young adults who were new abusers of prescription painkillers grew from 400,000 in the mid-1980s to 2 million by the late 2000s, according to a recent study by the Substance Abuse and Mental Health Services Administration.

New misusers of tranquilizers, which are normally used to treat anxiety or tension, increased nearly 50 percent between 1999 and 2009 alone. The ever-growing population of aging Baby Boomers and the elderly are also prime candidates from prescription drug abuse. There are many reasons for the increase in this type of drug abuse; the availability of the drugs, including online pharmacies and illegal street sales that make it easier to get the drugs without a prescription, even for minors, is a huge factor. Additionally, there is the perception that prescription drugs are safer than illegal substances such as heroin and cocaine. Unfortunately, most people do not lock up their prescription medications, nor do they discard them when they are no longer needed for their intended use, making them susceptible to misuse as well as theft.

Underlying all this is the fact that some prescription drugs are highly addictive; particularly when they are used in a manner inconsistent with their labeling or for reasons they were not prescribed. According to studies, the most abused prescriptions include, but are not limited to, narcotic painkillers like OxyContin or Vicodin, sedatives and tranquilizers such as Xanax or Valium, and stimulants like Dexedrine, Adderall, or Ritalin. As can be surmised from the above, more effective steps to curb prescription drug abuse are necessary to ensure that such statistics do not continue to rise.

Various attempts have been made to solve the above-mentioned problems such as those found in U.S. Pub. No. 2014/0074283 to Christopher Blackburn, U.S. Pat. No. 6,415,202 to Van Halfacre, and U.S. Pub. No. 2010/0228141 to Theodosios Kountotsis. This art is representative of prescription medication drug dispensing and regulating devices. None of the above inventions and patents, taken either singly or in combination, is seen to describe the invention as claimed.

Ideally, a tamper-proof prescription medication dispensing system should provide a means by which prescription medication can be destroyed when a dispenser is tampered with rendering the drugs useless for misuse and, yet would operate reliably and be manufactured at a modest expense. Thus, a need exists for a reliable tamper-proof prescription medication dispensing system to avoid the above-mentioned problems.

BRIEF SUMMARY OF THE INVENTION

In view of the foregoing disadvantages inherent in the known prescription medication dispensing device art, the present invention provides a novel tamper-proof prescription medication dispensing system. The general purpose of the present invention, which will be described subsequently in greater detail, is to provide a means for preventing misuse of prescription pills. The exemplary embodiment(s) satisfy such a need by providing a prescription drug monitoring/dispensing device that is convenient and easy to use, lightweight yet durable in design, versatile in its applications, and designed for ensuring the drug is taken only as directed, and not abused or sold on the streets.

A prescription medication security and dispensing system as disclosed herein in a particular embodiment may comprise: a device-housing, a prescription medication delivery assembly comprising a carousel (comprising a base-plate having a plurality of base-plate openings, a top-plate having a plurality of top-plate openings, a center rod, a crank, an electric motor), and a carousel power-supplier, a plurality of pill-retaining cylindrical compartments, a delivery chute, a delivery door, a programmable interface comprising, a microcontroller, a wireless transmitter and transceiver unit, a memory device, a user-inputter (the user-inputter comprising a LCD touch screen display, the user-inputter structured and arranged to accept an authorization key), the authorization key comprising a numerical security code, a biometric finger scanner for scanning and reading at least one fingerprint, and a power source, at least one tamper-detecting sensor, and a pill-dump funnel, and a prescription medication destruction unit comprising a medication destruction unit enclosure; the medication destruction unit enclosure comprising thermal insulation, a dual-blade fan, the dual-blade fan powered by a small induction motor (the dual-blade fan mounted to a bottom-opening of the pill-dump funnel), a vitrification chamber; the vitrification chamber comprising at least one chemical-retaining-reagent for retaining at least one chemical agent; the at least one chemical-retaining-reagent structured and arranged to open and close to release a mixable-quantity of the at least one chemical agent. The vitrification chamber further comprises at least one vent to prevent pressure buildup from reaction product gases.

The present system further comprises a destruction unit microprocessor; the microprocessor structured to control a volume of the mixable-quantity of the at least one chemical agent to be released into the vitrification chamber according to a quantity and an identity of at least one prescription medication pill being destroyed in the vitrification chamber. The prescription medication security and dispensing system may further comprise a signal receiver, and a medication destruction power supplier. It should be noted that the device-housing, the prescription medication delivery assembly, and the prescription medication destruction unit comprises in functional combination the prescription medication security and dispensing system.

The device-housing comprises an inner volume and further comprises a top and a bottom; the top comprising a device-door. The device-door is lockable via a device-lock and openable via a device-key. The inner volume of the device-housing is preferably bifurcated into an upper-section and a lower-section. The prescription medication delivery assembly is integrally located inside the upper-section of the device-housing.

In this particular embodiment the base-plate and the top-plate of the carousel each comprise a center hole and the plurality of base-plate openings and the plurality of top-plate openings are of equal dimension. As such, the center rod transverses the center holes of the base-plate and the top-plate such that the base-plate and the top-plate are fixedly mounted to the center rod. The plurality of pill-retaining cylindrical compartments comprises removable capsules structured and arranged to fit within the plurality of base-plate openings of the base-plate and the plurality of top-plate openings of the top-plate. A bottom of the center rod is mounted to the crank, the crank turned by the electric motor; the electric motor powered by the carousel power-supplier.

The plurality of pill-retaining cylindrical compartments are structured and arranged to store at least one prescription medication pill in a vertically stack. Each of the plurality of pill-retaining cylindrical compartments may comprise a manually-openable compartment-top. Each of the plurality of pill-retaining cylindrical compartments may comprise an electronic component which may be structured and arranged to open the compartment-bottom. The electronic component may be in wireless communication with the microcontroller of the programmable interface. The delivery chute in this particular embodiment is located underneath the base-plate of the carousel.

A top-opening of the delivery-chute comprises a pill delivery point. The top-opening of the delivery-chute comprising the pill delivery point is in direct alignment underneath one of the plurality of openings of the base-plate. The delivery-chute comprises a slide connecting the pill delivery point to a pill delivery area. The pill delivery area may be located adjacent the delivery door. Further, the delivery door may comprise a delivery-door electronic component in communication with the microcontroller of the programmable interface. The delivery-door further comprises a locking mechanism controlled by the delivery-door electronic component such that the locking mechanism of the delivery door is temporarily unlocked upon receipt of the authorization key by the user-inputter.

The power source provides operating power to the programmable interface. The microcontroller controls the programmable interface. The memory device is able to store at least one data file. At least one data file may comprise a plurality of prescription medication dispensing parameters for automatically dispensing prescription medication pill(s) according to a prescription. The user-inputter is located on an outside of the device-housing. The programmable interface is structured and arranged to receive and execute data commands communicated to the microcontroller via the user-inputter for programming the prescription medication dosage schedule storable on the memory device.

The tamper-detecting sensor(s) are structured and arranged to detect a tampering attempt by an unauthorized user and are strategically placed about the device-housing where a tamper-attempt may take place by the unauthorized user. Further, the tamper-detecting sensor(s) are structured and arranged to communicate a tamper-impulse signal to the microcontroller of the programmable interface upon detection of the tamper-attempt. The microcontroller transmits the tamper-impulse signal to the electronic component of each of the plurality of pill-retaining cylindrical compartments upon a detection of the tamper-impulse causing the compartment-bottom of the pill-retaining cylindrical compartments to swing open thereby emptying all prescription medication pills housed therein. The prescription medication destruction unit is integrally located inside the lower-section of the device-housing.

The pill-dump funnel is located between the prescription medication destruction unit and the prescription medication delivery assembly. The vitrification chamber, the destruction unit microprocessor, the signal receiver, and the medication destruction power supplier are fixedly mounted inside the medication destruction unit enclosure. The pill-dump funnel comprises a large bottom opening communicating downwardly into the vitrification chamber of the prescription medication destruction unit via an electronically-openable-entry of the medication destruction unit enclosure. The vitrification chamber, the destruction unit microprocessor, and the signal receiver are powered by the medication destruction power supplier. It should be appreciated that the vitrification chamber is structured and arranged to vitrify the at least one prescription medication pill.

As such, the prescription medication security and dispensing system is structured and arranged to deliver an entirety of the prescription medication pill(s) contained within each of the pill-retaining cylindrical compartments to the vitrification chamber for destruction upon a detection of the tamper-impulse signal transmitted to the signal receiver of the prescription medication destruction unit from the microcontroller of the programmable interface. As designed, the prescription medication security and dispensing system is useful to automatically dispense a prescription medication dosage to an authorized user according to the prescription medication dosage while also preventing an unauthorized person from accessing the at least one prescription medication pill by automatically destroying the at least one prescription medication pill upon detection of the tamper-attempt by the at least one tamper-detecting sensor.

To enable the present device (prescription medication security and dispensing system) at least one chemical agent may be used. A preferred chemical agent may comprise rapid cure epoxy for solidifying and encapsulating the prescription medication pill(s) after pulverization by the dual-blade fan. Other means for rendering the medication destroyed or sterile may be used.

A method of destroying at least one prescription medication pill stored within a prescription medication delivery assembly via a prescription medication destruction unit is also disclosed herein comprising the steps of: registering a tamper-attempt via at least one tamper-detecting sensor, transmitting a tamper-impulse signal from the at least one tamper-detecting sensor to a microcontroller of a prescription medication delivery assembly, dumping at least one prescription medication pill(s) retained in a plurality of pill-retaining cylindrical compartments into a pill-dump funnel, pulverizing the at least one prescription medication pill(s) via a dual-blade fan, and destroying the at least one prescription medication pill(s) via the prescription medication destruction unit. Other embodiments and method(s) are described in greater detail subsequently.

The present invention holds significant improvements and serves as a tamper-proof prescription medication dispensing system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, prescription medication security and dispensing systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a prescription medication dispensing and security apparatus and more particularly to a more secure tamper-proof prescription medication dispensing device for home or pharmaceutical use to prevent and deter drug abusers from accessing or using prescription medication retained inside the device by immediately destroying the prescription medication pills contained within upon detection of an attempted tamper or break in.

Generally speaking, prescription medication security and dispensing system may comprise device-housing which may integrally comprise prescription medication delivery assembly and prescription medication destruction unit. Prescription medication delivery assembly may be useful for regulating and delivering prescription medication pill(s) to user that is authorized to take a prescribed quantity of prescription medication pill(s) according to dosage schedule. Prescription medication destruction unit may be useful for pulverizing and chemically destroying prescription medication pill(s) contained within prescription medication delivery assembly in a safe and immediate manner should device-housing register a tamper-attempt via tamper-detecting sensor(s) strategically installed around device-housing. It is contemplated that embodiments disclosed herein of prescription medication security and dispensing system be primarily for home-use, such that prescription medication delivery assembly may be filled with by an authorized filler (such as a pharmacy, hospital, doctor, or clinic).

Figure 1:
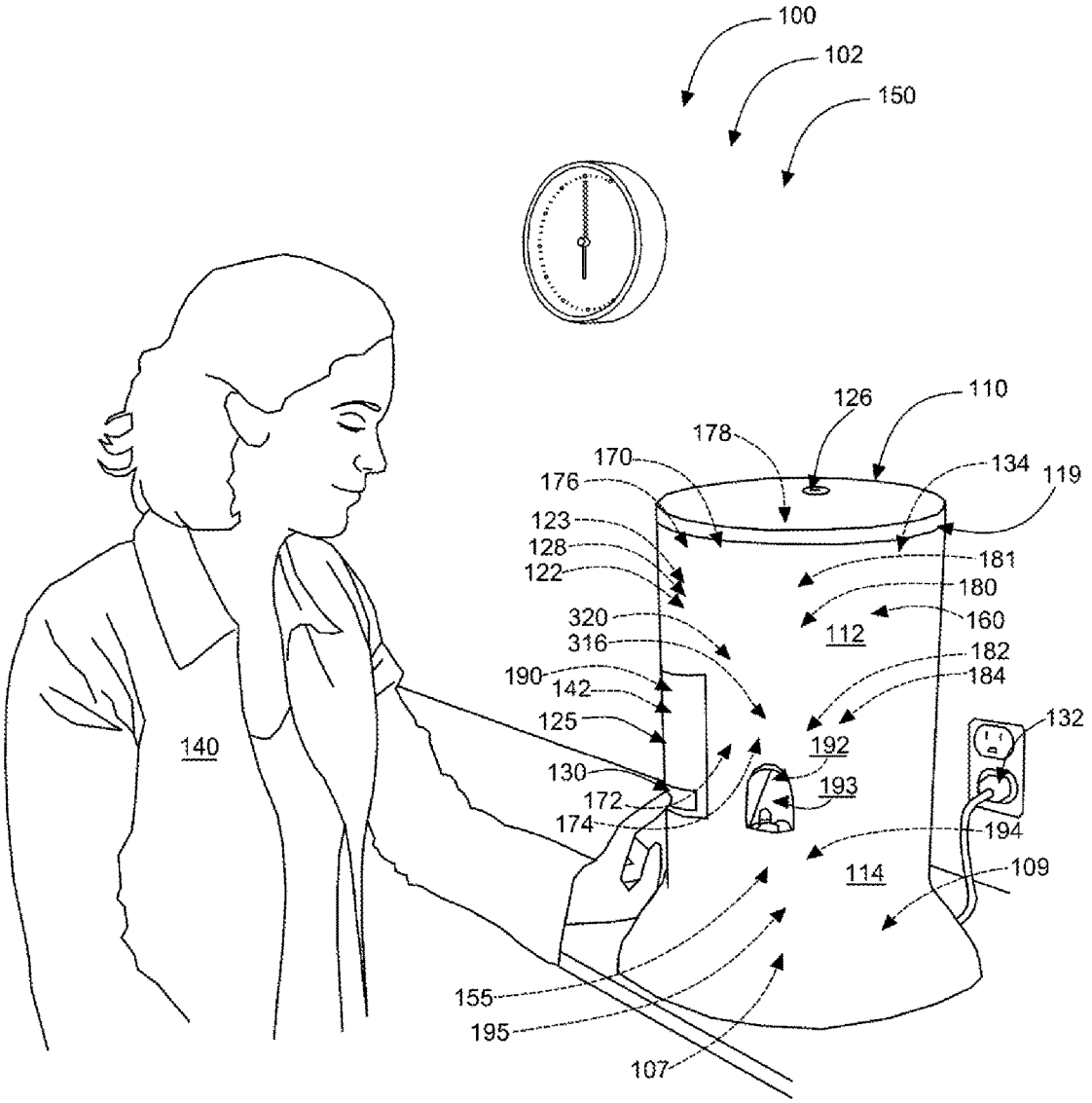
FIG. 1 shows a perspective view illustrating a prescription medication security and dispensing system during an 'in-use' condition showing an authorized user inputting an authorization key and accessing a dosage of prescription medication according to an embodiment of the present invention.

Referring to the drawings by numerals of reference there is shown in FIG. 1, a perspective view illustrating prescription medication security and dispensing system 100 during 'in-use' condition 150 showing authorized user 140 inputting an authorization key comprising a secure passcode into user-inputter 130 and accessing a dosage of prescription medication (prescription medication pill(s) 160) according to an embodiment of the present invention.

An embodiment (rapid oxidation version) of prescription medication security and dispensing system 100 comprises: device-housing 110; prescription medication delivery assembly 102 comprising carousel 170 comprising base-plate 172 having plurality of base-plate openings 174; top-plate 176 having plurality of top-plate openings 178; center rod 180; crank 182; electric motor 184; and carousel power-supplier 186; plurality of pill-retaining cylindrical compartments 188; delivery chute 192; delivery door 120; programmable interface 125 comprising microcontroller 122; wireless transmitter and transceiver unit 128; memory device 123; user-inputter 130; and power source 132; at least one tamper-detecting sensor 134; and pill-dump funnel 194.

Prescription medication destruction unit 104 comprises medication destruction unit enclosure 106; oxidation chamber 108; destruction unit microprocessor 162; signal receiver 164; and medication destruction power supplier 166. Device-housing 110, prescription medication delivery assembly 102, and prescription medication destruction unit 104 comprises in functional combination prescription medication security and dispensing system 100. Device-housing 110 in this particular embodiment preferably comprises a cylindrical profile and inner volume 118. Device-housing 110 comprises a top and a bottom, as shown. Inner volume 118 of device-housing 110 may be bifurcated into upper-section 112; and lower-section 114. Prescription medication delivery assembly 102 is integrally located inside upper-section 112 of device-housing 110. Base-plate 172 and top-plate 176 of carousel 170 each comprise center hole 181. Plurality of base-plate openings 174 and plurality of top-plate openings 178 are preferably of equal dimension. Center rod 180 transversing center hole(s) 181 of base-plate 172 and top-plate 176 such that base-plate 172 and top-plate 176 are fixedly mounted to center rod 180. Plurality of pill-retaining cylindrical compartments 188 comprises removable capsules 189 structured and arranged to fit within plurality of base-plate openings 174 of base-plate 172 and plurality of top-plate openings 178 of top-plate 176.

A bottom of center rod 180 is mounted to crank 182 turned by electric motor 184. Electric motor 184 is powered by the carousel power-supplier 186. It should be appreciated plurality of pill-retaining cylindrical compartments 188 are structured and arranged to store prescription medication pill(s) 160 in a vertical stack (as shown best in FIG. 5B). In this particular embodiment, each of pill-retaining cylindrical compartments 188 comprises manually-openable compartment-top 196. Each of plurality of pill-retaining cylindrical compartments 188 comprises electronic component 505 which may be structured and arranged to open compartment-bottom 198. Electronic component 505 is in communication with microcontroller 122 of programmable interface 125.

Delivery chute 192 is preferably located underneath base-plate 172 of carousel 170. Top-opening 119 of delivery-chute 192 comprises pill delivery point 117. Top-opening 119 of delivery-chute 192 comprising pill delivery point 117 is in direct alignment underneath one of plurality of openings of base-plate 172. Delivery-chute 192 comprises slide 193 connecting pill delivery point 117 to pill delivery area 116. Pill delivery area 116 is located adjacent delivery door 120. Delivery door 120 may comprise delivery-door electronic component 152 which may be in communication with microcontroller 122 of programmable interface 125. Further, delivery-door 120 comprises locking mechanism 121 controlled by delivery-door electronic component 152. It should be noted power source 132 provides operating power to programmable interface 125. Microcontroller 122 controls programmable interface 125. Memory device 123 may store at least one executable data file. It should be noted that at least one data file comprises prescription medication dispensing parameters for automatically dispensing prescription medication pill(s) 160 according to a prescription medication dosage schedule.

User-inputter 130 is located on an outside of device-housing 110. Programmable interface 125 is structured and arranged to receive and execute data commands communicated to microcontroller 122 via user-inputter 130 for programming prescription medication dosage schedule storable on memory device 123.

Prescription medication security and dispensing system 100 may comprise tamper-detecting sensor(s) 134 strategically mounted about device-housing 110. Tamper-detecting sensor(s) 134 are structured and arranged to detect a tampering attempt by an unauthorized user (ie. drug abuser, delinquent, etc.). Tamper-detecting sensor(s) 134 are structured and arranged to communicate tamper-impulse signal 710 to microcontroller 122 of programmable interface 125.

Microcontroller 122 transmits tamper-impulse signal 710 to electronic component 505 of each of plurality of pill-retaining cylindrical compartment(s) 188 upon a detection of the tamper-attempt. Electronic component 505 may cause compartment-bottom 198 to swing open upon detection of tamper-impulse signal 710.

Prescription medication destruction unit 104 is integrally located inside lower-section 114 of the device-housing 110. Pill-dump funnel 194 is located between the prescription medication destruction unit 104 and prescription medication delivery assembly 102. In this particular embodiment, oxidation chamber 108, destruction unit microprocessor 162, signal receiver 164, and medication destruction power supplier 166 are fixedly mounted inside medication destruction unit enclosure 106.

Pill-dump funnel 194 may comprise large bottom opening 195 communicating downwardly into oxidation chamber 108 of prescription medication destruction unit 104 via an electronically-openable-entry of medication destruction unit enclosure 106. Oxidation chamber 108, destruction unit microprocessor 162, and signal receiver 164 are powered by medication destruction power supplier 166. Oxidation chamber 108 is structured and arranged to oxidize the prescription medication pill(s) 160. Prescription medication security and dispensing system 100 is structured and arranged to deliver an entirety of prescription medication pill(s) 160 encased within each of pill-retaining cylindrical compartments 188 to oxidation chamber 108 for destruction upon a detection of tamper-impulse signal 710 transmitted to signal receiver 164 of prescription medication destruction unit 104 from microcontroller 122 of programmable interface 125.

As such, prescription medication security and dispensing system 100 is useful to automatically dispense a prescription medication dosage of prescription medication pill(s) 160 to user 140 according to the prescription medication dosage while also preventing an unauthorized person from accessing prescription medication pill(s) 160 by automatically destroying prescription medication pill(s) 160 upon detection of the tamper-attempt by tamper-detecting sensor 134.

Referring now again to user-inputter 130, user-inputter 130 is structured and arranged to accept an authorization key relating to user 140 that is authorized to access the prescription medication dosage pursuant to the prescription medication dosage schedule for user 140. Locking mechanism 121 of delivery door 120 is able to be temporarily unlocked upon receipt of the authorization key for allowing user 140 that is authorized to access prescription medication pill(s) 160.

In one embodiment, the authorization key may comprise a numerical security code. In a more secure embodiment, user-inputter 130 of prescription medication security and dispensing system 100 may comprise biometric finger scanner 142 for scanning and reading at least one fingerprint of user 140 that is authorized such that the at least one fingerprint comprises the authorization key. The top of device-housing 110 comprises a device-door which is lockable via a device-lock and openable via a device-key (as shown in FIGS. 2A and 2B).

Figure 2A:
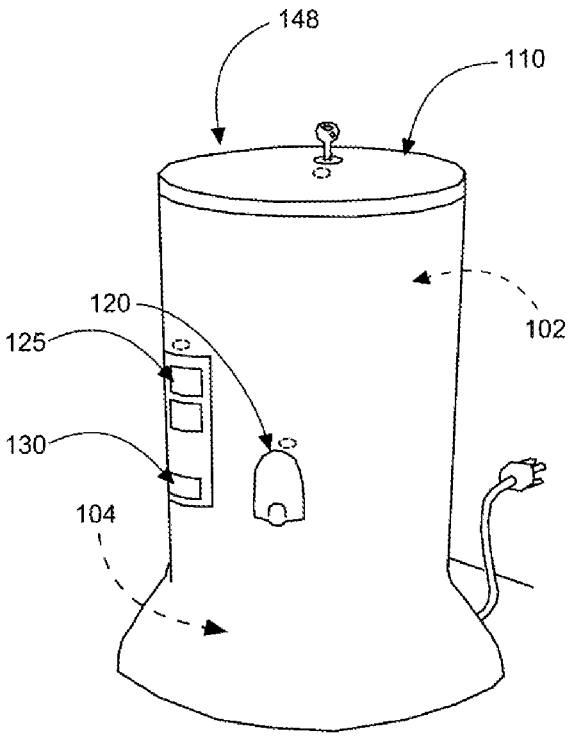
FIG. 2A is a perspective view illustrating a prescription medication security and dispensing system in a closed condition and comprising a prescription medication delivery assembly, a prescription medication destruction unit, and a plurality of tamper-detecting sensors according to an embodiment of the present invention of FIG. 1.

Referring now to FIG. 2A showing a perspective view illustrating prescription medication security and dispensing system 100 in closed condition 148 and comprising prescription medication delivery assembly 102, prescription medication destruction unit 104, and plurality of tamper-detecting sensors 134 according to an embodiment of the present invention of FIG. 1. As shown, user-inputter 130 may comprise a LCD touch screen display for user-input and information display according to an embodiment of the present invention.

Figure 2B:
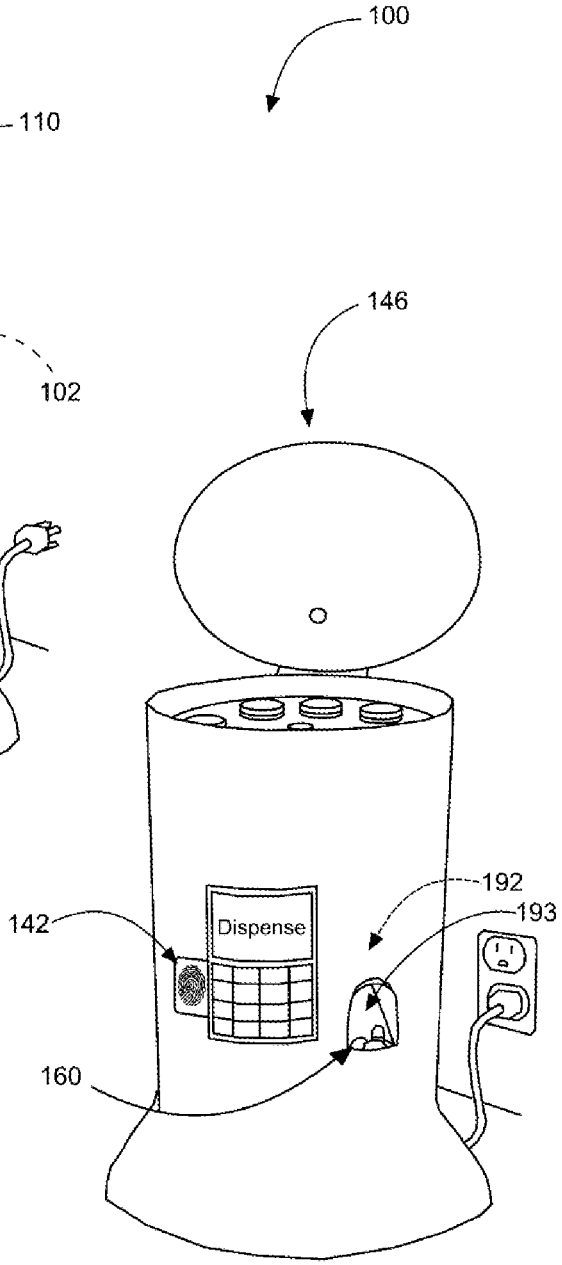
FIG. 2B is a perspective view illustrating the prescription medication security and dispensing system in an open condition according to an embodiment of the present invention of FIG. 2A.

FIG. 2B shows a perspective view illustrating prescription medication security and dispensing system 100 in open condition 146 according to an embodiment of the present invention of FIG. 2A.

In one embodiment of the present invention, programmable interface 125 may comprise prompts for welcome screen, authorization and security, medication information (ie. name, manufacturer of drug, size (mg) of drug, dosing instructions, doctor information, time remaining until next dose, quantity remaining, dispensing history, tamper checks, battery level, and pharmacy information), help menu (ie. device help, passcode reset, battery power check, and support contact information. In a so-equipped embodiment of the present invention, the biometric thumb print scanner (biometric finger scanner 142) will be a form of security prohibiting unauthorized users from accessing the prescription medication. Other security means may be used.

Figure 3:
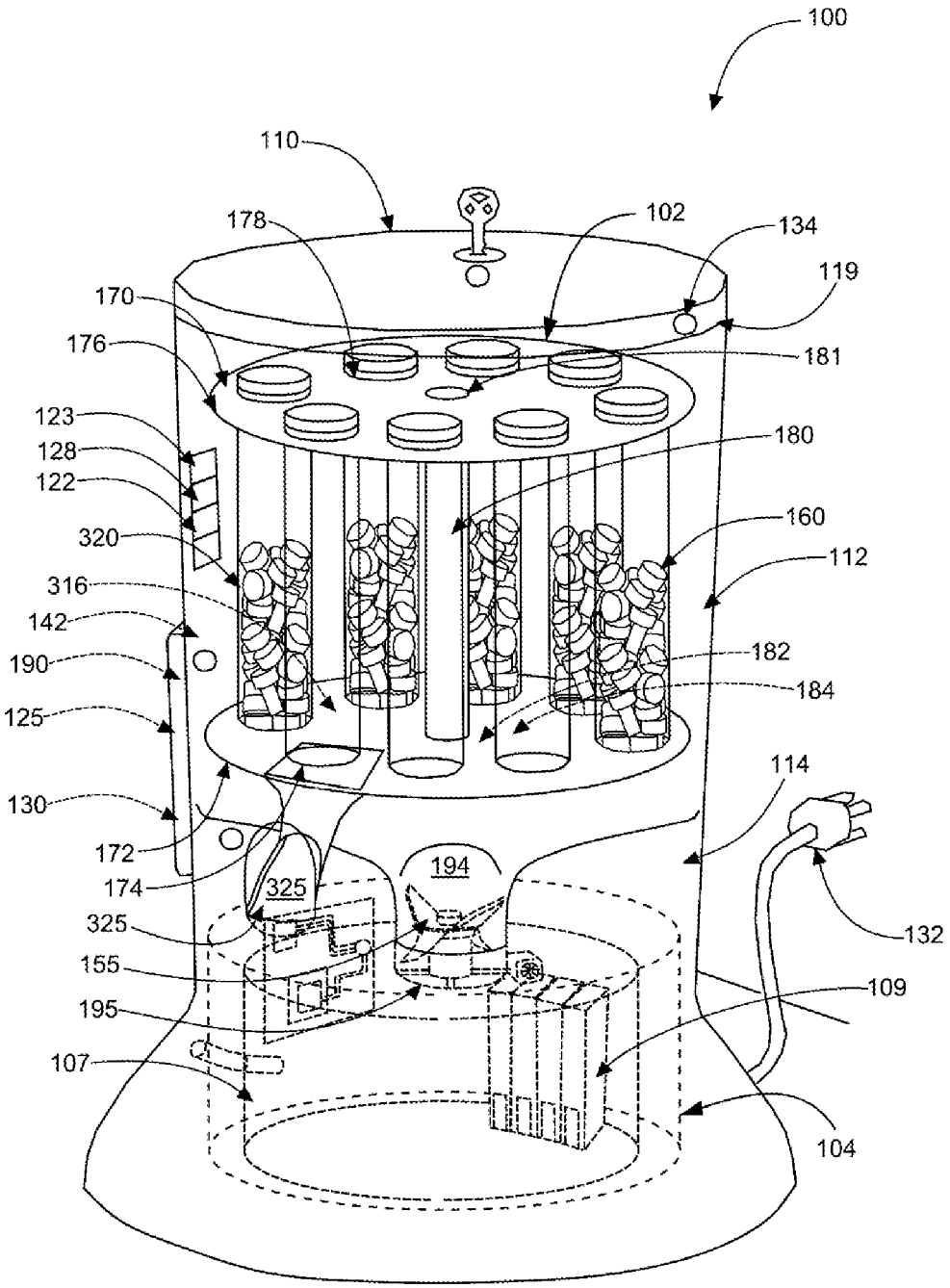
FIG. 3 is an interior-perspective view illustrating the prescription medication delivery assembly comprising a carousel and a plurality of pill-retaining cylindrical compartments according to an embodiment of the present invention.
Figure 4:
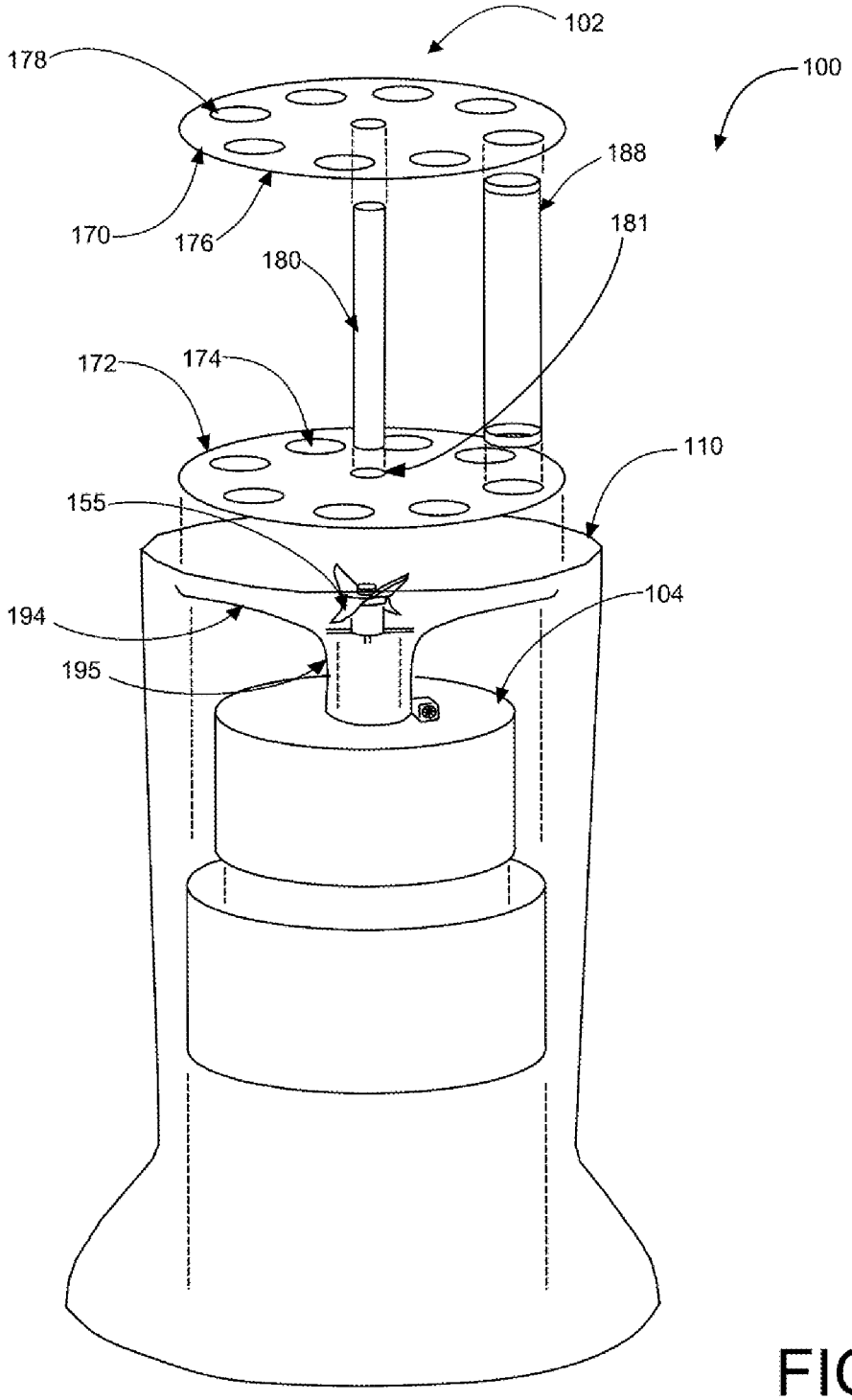
FIG. 4 is an exploded view illustrating the prescription medication delivery assembly, a pill-dump funnel, and the prescription medication destruction unit encased inside a device-housing of the prescription medication security and dispensing system according to an embodiment of the present invention of FIGS. 1-3.

Referring now to FIG. 3 showing an interior-perspective view illustrating prescription medication delivery assembly 102 comprising carousel 170 and plurality of pill-retaining cylindrical compartments 188 according to an embodiment of the present invention. Next, FIG. 4 shows an exploded view illustrating prescription medication delivery assembly 102, pill-dump funnel 194, and prescription medication destruction unit encased inside device-housing 110 of prescription medication security and dispensing system 100 according to an embodiment of the present invention of FIGS. 1-3.

Figure 5A:
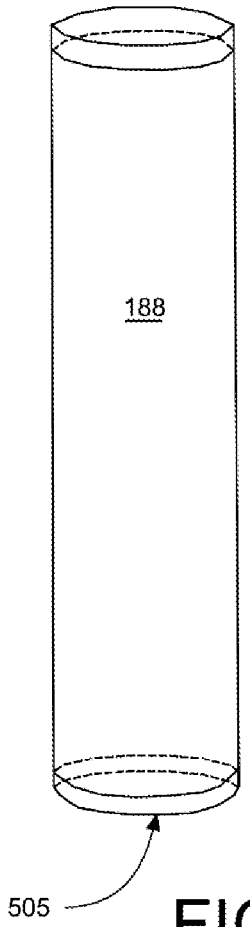
FIG. 5A is a perspective view of an empty pill-retaining cylindrical compartment according to an embodiment of the present invention of FIGS. 1-4.
Figure 5B:
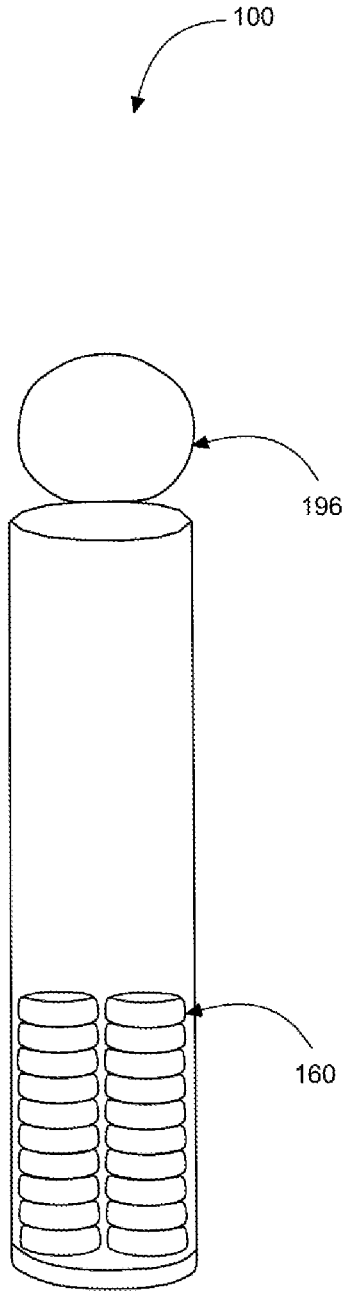
FIG. 5B is a perspective view of a partially filled pill-retaining cylindrical compartment comprising a manually-openable compartment-top for inserting at least one prescription medication pill and an electronic component structured and arranged to open a compartment-bottom for releasing at least one prescription medication pill according to an embodiment of the present invention of FIGS. 1-4.

Referring now to FIG. 5A showing a perspective view of pill-retaining cylindrical compartment 188 that is empty according to an embodiment of the present invention of FIGS. 1-4. Referring to FIG. 5B showing a perspective view of pill-retaining cylindrical compartment 188 that is empty and comprising manually-openable compartment-top 196 for inserting prescription medication pill(s) 160 and electronic component 505 structured and arranged to open compartment-bottom 198 for releasing prescription medication pill(s) 160 according to an embodiment of the present invention of FIGS. 1-4.

Figure 6:
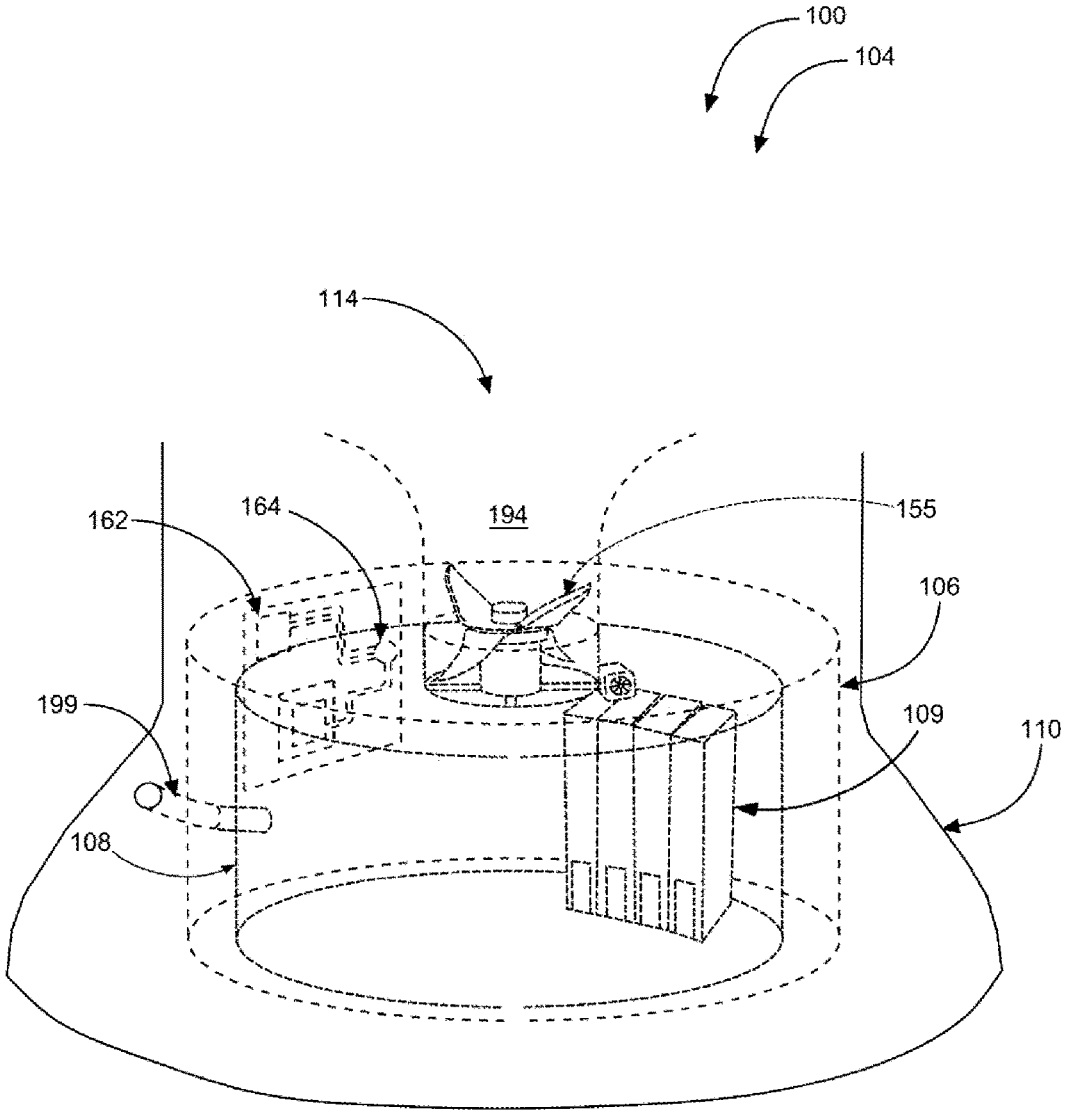
FIG. 6 is an interior view illustrating a lower-section of the device-housing comprising the prescription medication destruction unit comprising an vitrification chamber for destroying all prescription medication stored in the prescription medication delivery assembly according to an embodiment of the present invention of FIGS. 1-5.

FIG. 6 shows an interior view illustrating lower-section 114 of device-housing 110 comprising prescription medication destruction unit 104 comprising oxidation chamber 108 for destroying all prescription medication (prescription medication pill(s) 160) stored in prescription medication delivery assembly 102 according to an embodiment of the present invention of FIGS. 1-5.

Oxidation chamber 108 may comprise at least one chemical-retaining-reagent 109 for retaining at least one chemical agent useful for destroying at least one prescription medication pill 160. Prescription medication destruction unit 104 preferably further comprises dual-blade fan 155 powered by a small induction motor and mounted to bottom-opening 195 of pill-dump funnel 194 for pulverizing at least one prescription medication pill 160 passing there-through into oxidation chamber 108. Dual-blade fan 155 chops and powders prescription medication pill(s) 160 so they are more easily and quickly able to be destroyed given the contact area that the 'destroying means' may contact.

In certain embodiments, the medication destruction unit enclosure 106 may comprise thermal insulation to prevent excess environment heating caused by exothermic decomposition in regard to safety of use of the present invention. Oxidation chamber 108 comprises vent 199 in these embodiments to prevent pressure buildup from reaction product gases.

Figure 7A:
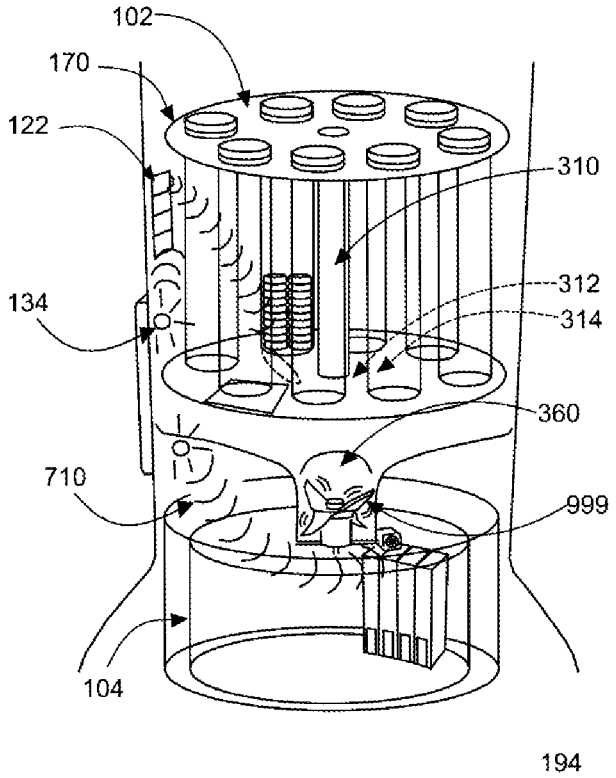
FIG. 7A is a perspective view showing the tamper-detecting sensor wirelessly communicating a tamper-impulse signal to a microcontroller of the programmable interface of the prescription medication delivery assembly upon detection of a tamper-attempt by an unauthorized user according to an embodiment of the present invention of FIGS. 1-6.

Referring now to FIG. 7A, a perspective view showing tamper-detecting sensor 134 wirelessly communicating tamper-impulse signal 710 to microcontroller 122 of programmable interface 125 of prescription medication delivery assembly 102 upon detection of a tamper-attempt by an unauthorized user according to an embodiment of the present invention of FIGS. 1-6.

Figure 7B:
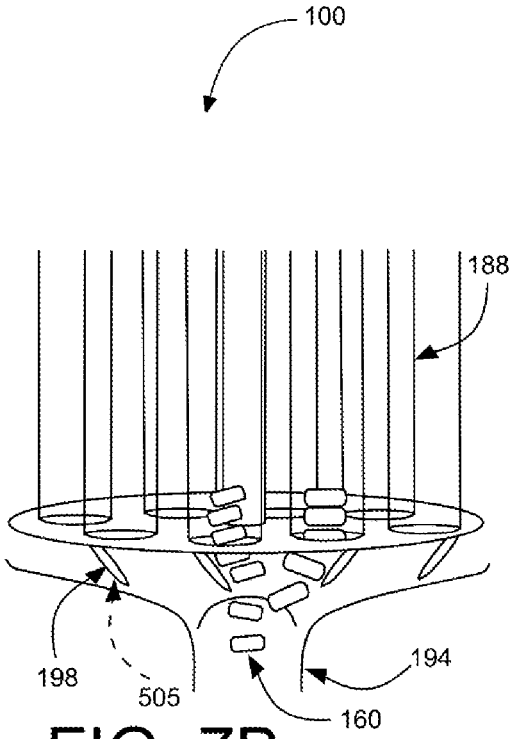
FIG. 7B is a perspective view showing the electronic component(s) causing the compartment-bottom(s) of the pill-retaining cylindrical compartment(s) to immediately open upon receipt of the tamper-impulse signal by the microcontroller and releasing all prescription medication into the pill-dump funnel according to an embodiment of the present invention of FIGS. 1-6.

FIG. 7B is a perspective view showing electronic component(s) 505 causing compartment-bottom(s) 198 of pill-retaining cylindrical compartment(s) 188 to immediately open upon receipt of tamper-impulse signal 710 by microcontroller 122 and release all prescription medication (prescription medication pill(s) 160) into pill-dump funnel 194 according to an embodiment of the present invention of FIGS. 1-6.

Figure 7C:
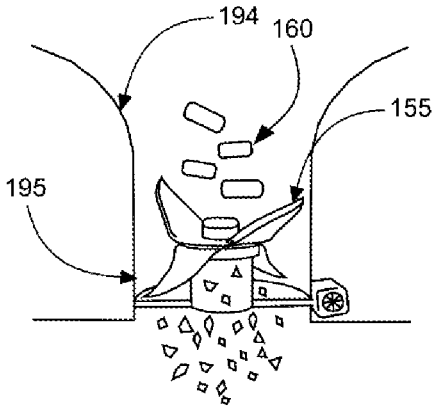
FIG. 7C is a perspective view illustrating the prescription medication pills dropping down through the pull-dump funnel and passing through a dual-blade fan for pulverizing the prescription medication pills according to an embodiment of the present invention of FIGS. 1-6.

FIG. 7C is a perspective view illustrating prescription medication pill(s) 160 dropping down through pull-dump funnel 194 and passing through dual-blade fan 155 for pulverizing prescription medication pills 160 according to an embodiment of the present invention of FIGS. 1-6.

Figure 7D:
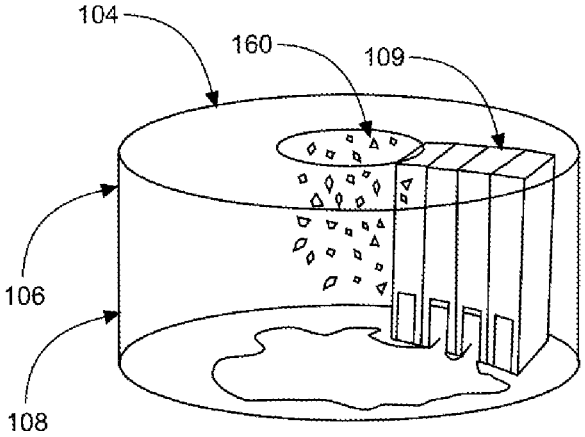
FIG. 7D is a perspective view showing the prescription medication pills comprising fragments after being pulverized and entering into the vitrification chamber of the prescription medication destruction unit for introduction to at least one chemical agent useful for destroying the prescription medication pills according to an embodiment of the present invention of FIGS. 1-6.

FIG. 7D is a perspective view showing prescription medication pills 160 comprising fragments after being pulverized and entering into oxidation chamber 108 of prescription medication destruction unit 104 for introduction to at least one chemical agent useful for destroying prescription medication pills 160 according to an embodiment of the present invention of FIGS. 1-6.

Figure 8A:
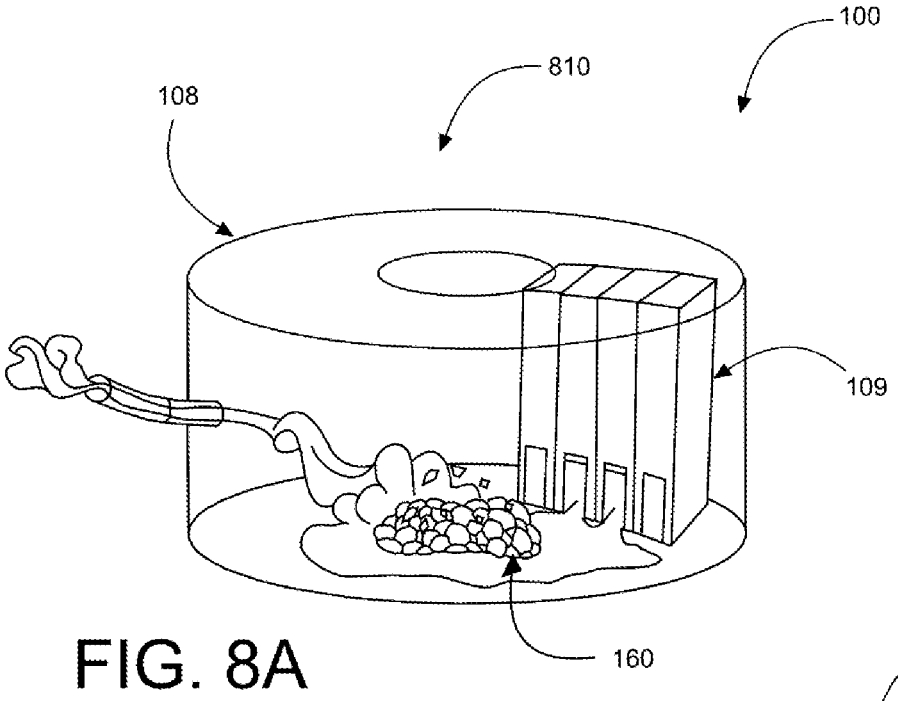
FIG. 8A is a perspective view illustrating a first-drug-destroying means utilizing Fe/H202 to oxidize the prescription medication pills comprising fragments after being pulverized according to an embodiment of the present invention.

Referring now to FIG. 8A showing a perspective view illustrating first-drug-destroying means 810 utilizing $Fe_2$+/$H_2O_2$ to oxidize prescription medication pills 160 comprising fragments after being pulverized according to an embodiment of the present invention.

Chemical-retaining-reagent 109 may be structured and arranged to open and close to release a mixable-quantity of the at least one chemical agent into oxidation chamber 108 upon receipt of the tamper-impulse signal by signal receiver 164 of prescription medication destruction unit 104 such that the chemical agent(s) are sufficiently mixed within oxidation chamber 108. The destruction unit microprocessor controls a volume of the mixable-quantity of the at least one chemical agent to be released into oxidation chamber 108 according to a quantity and an identity of at least one prescription medication pill 160 being destroyed in oxidation chamber 108.

The at least one chemical agent retained in the at least one chemical-retaining-reagent may comprise hydrogen peroxide useful for a first-oxidation means for destroying at least one prescription medication pill(s) 160. Further, the at least one chemical agent retained in chemical-retaining-reagent 109 may comprise a quantity of acidified ferrous sulfate useful for the first-oxidation means for destroying at least one prescription medication pill 160. The at least one chemical agent retained in chemical-retaining-reagent 109 may comprise a quantity of potassium permanganate useful for a second-oxidation means for destroying the at least one prescription medication pill 160. The at least one chemical agent retained in the at least one chemical-retaining-reagent may comprise a quantity of sodium hydroxide useful for the second-oxidation means for destroying prescription medication pill(s) 160. The $FeSO_4$ and $H_2O_2$ should be mixed to achieve a 1:5-10 wt/wt ratio of $Fe_2$+ to $H_2O_2$, though actual amounts may be tailored for individual drug types.

Figure 8B:
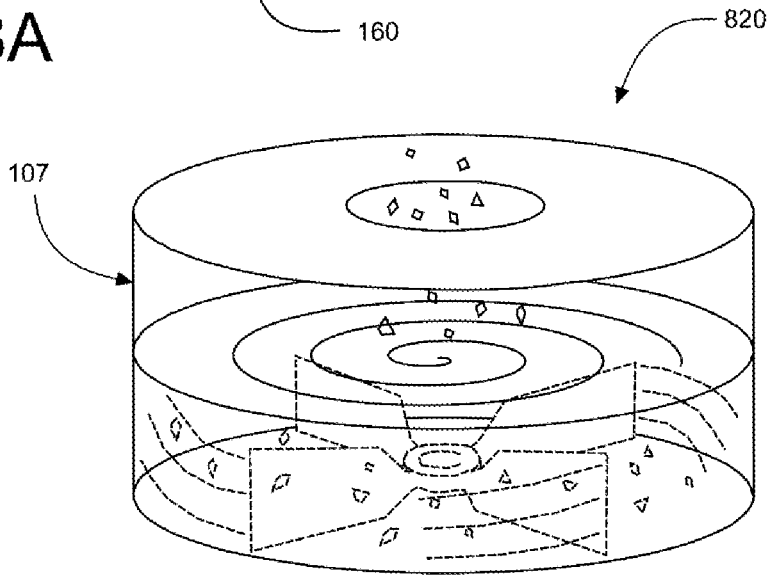
FIG. 8B is a perspective view illustrating a second-drug-destroying means utilizing rapid cure epoxy to vitrify the prescription medication pills comprising fragments after being pulverized according to an embodiment of the present invention.

Referring now to FIG. 8B showing a perspective view illustrating second-drug-destroying means 820 utilizing rapid cure epoxy to vitrify prescription medication pills 160 comprising fragments after being pulverized according to an embodiment of the present invention.

In a preferred embodiment of the present invention, vitrification chamber 107 may be used comprising chemical-retaining-reagent 109 for retaining at least one chemical agent. Chemical-retaining-reagent 109 may be structured and arranged to open and close to release a mixable-quantity of the at least one chemical agent. Vitrification chamber 107 may further comprise vent 199 (as shown in FIGS. 6 and 8B) to prevent pressure buildup from reaction product gases; and destruction unit microprocessor 162. Destruction unit microprocessor 162 may be structured to control a volume of the mixable-quantity of the at least one chemical agent to be released into vitrification chamber 107 according to a quantity and an identity of prescription medication pill(s) 160 being destroyed in vitrification chamber 107.

It should be noted that prescription medication delivery assembly 102 and prescription medication destruction unit 104 comprises in functional combination prescription medication security and dispensing system 100. Device-housing 110 comprises inner volume 118, a top and a bottom; the top comprising a device-door. The delivery door may be lockable via a device-lock and openable via a device-key. Device-housing 110 is preferably bifurcated into an upper-section 112 and a lower-section 114. Prescription medication delivery assembly 102 may be integrally located inside the upper-section of the device-housing 110 to promote security.

Plurality of pill-retaining cylindrical compartments 188 are structured and arranged to store prescription medication pill(s) 160 in a vertically stack (some pills may come loosely stacked and others may come with sleeves). The at least one chemical agent may comprise rapid cure epoxy for solidifying and encapsulating prescription medication pill(s) 160 after pulverization by dual-blade fan 155. In such a manner, prescription medication pill(s) 160 get pulverized and enter prescription medication destruction unit 104 containing rapid cure epoxy. Preferably, the rapid cure epoxy may be colored the same as medication pill(s) 160. The remnants from prescription medication pill(s) 160 gets mixed with the epoxy, which may harden before an unauthorized user has an opportunity to break into medication destruction unit enclosure 106. If the unauthorized user somehow manages to break into medication destruction unit enclosure 106, the unauthorized user may only discover a hard, hot mass of solid plastic (ie hardened epoxy) with no visible evidence of prescription medication pill(s) 160 and no way to ever recover them. The heat from the epoxy curing may decompose prescription medication pill(s) 160 as well during the process.

Further, vitrification chamber 107 may comprise, in alternate embodiments, a disposable inner container that may rotate while prescription medication pill(s) 160 are being pulverized and blown into the container and the resin and hardener are entering. The rotation may help provide suitable mixing. Alternately a "paddle" mechanism may be used that spins and mixes the materials, as shown in FIG. 8B. Alternatively cyanoacrylates with accelerators and even acrylic dental resins may be utilized which may harden very quickly upon exposure to UV light.

As prescription medication pill(s) 160 are pulverized they enter the destruction chamber as fine powder. Ideally the powder will be disbursed through the chamber by forced air flow from dual-blade fan 155. At the same time, 1:1 quantities of ultra fast cure epoxy resin and hardener may flow into the chamber from chemical-retaining-reagent(s) 109. Prescription medication pill(s) 160 comprising fine powder may then be incorporated into the epoxy mixture as vitrification chamber 107 fills. After all prescription medication pill(s) 160 have been pulverized, flow of epoxy resin and hardener will continue for short time to ensure all of the drug powder from prescription medication pill(s) 160 is contained within the epoxy mixture. The rapid cure of the epoxy will seal prescription medication pill(s) 160 into a hard plastic- or glass-like mass. Since the curing of epoxy is often highly exothermic, the heat from curing will likely cause many of prescription medication pill(s) 160 to decompose during the process. The epoxy resin and hardener may be colored with pigment to match the color of the drugs so it will be impossible to distinguish the drug particles within the cured epoxy mass. As an alternative to epoxy resins, cyanoacrylates may also be used with the controlled addition of chemical accelerators.

Prescription medication security and dispensing system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 9:
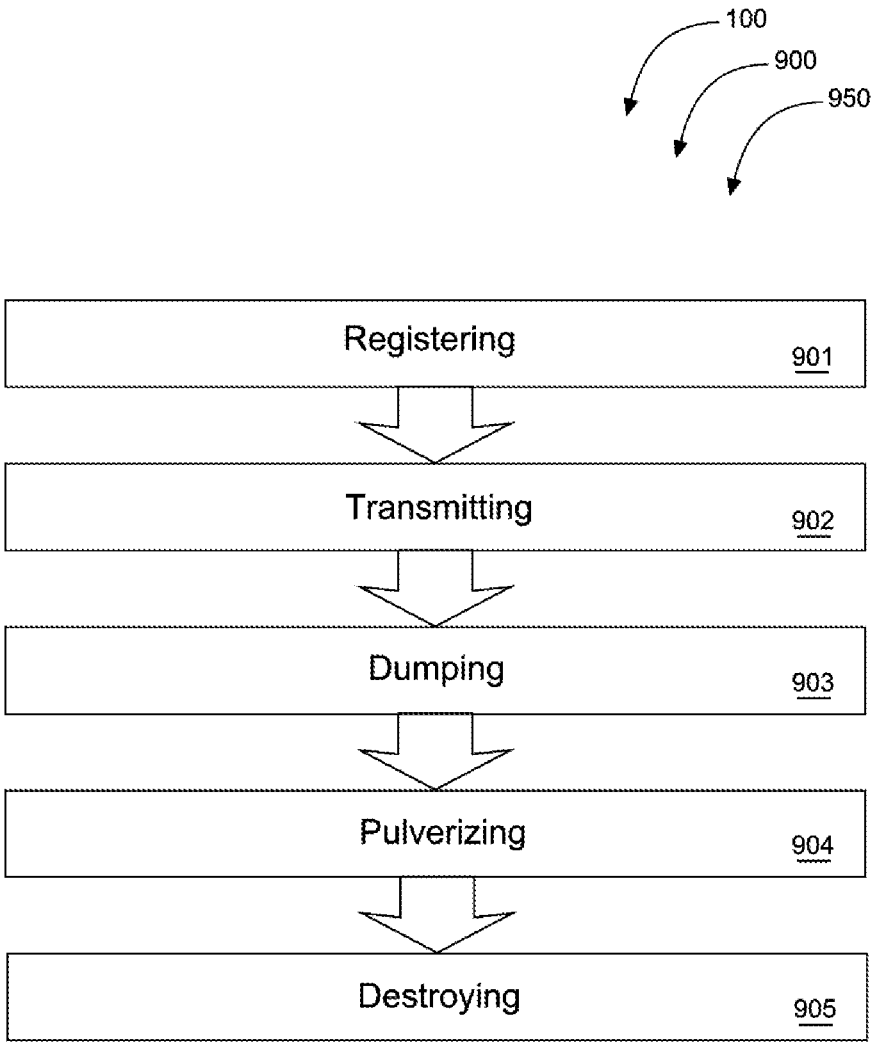
FIG. 9 is a flowchart illustrating a method of use for destroying the prescription medication pills upon delivery of the tamper-impulse signal according to an embodiment of the present invention of FIGS. 1-8B.

Flowchart 950 showing method of use 900 of destroying prescription medication pill(s) 160 stored within prescription medication delivery assembly 102 via prescription medication destruction unit 104 is shown in FIG. 9 according to an embodiment of the present invention of FIGS. 1-8B. As shown, method of use 900 may comprise the steps of: step one 901 registering a tamper-attempt via tamper-detecting sensor 134; step two 902 transmitting tamper-impulse signal 710 from tamper-detecting sensor 134 to microcontroller 122 of prescription medication delivery assembly 102; step three 903 dumping prescription medication pill(s) 160 retained in plurality of pill-retaining cylindrical compartments 188 into pill-dump funnel 194; step four 904 pulverizing prescription medication pill(s) 160 via dual-blade fan 155; and step five 905 destroying prescription medication pill(s) 160 via prescription medication destruction unit 104.

In one particular embodiment, prescription medication security and dispensing system (also known as "D-4") may comprise a rectangular unit measuring approximately four inches (4") in height, six inches (6") in width, and two inches (2") in depth (measurements and sizes may vary). The exterior front panel of the unit may offer a small blue backlit liquid crystal display screen (LCD) connected to a controller that may serve to convey the amount of product remaining, the time until the next prescribed dosage, customer services Frequently Asked Questions (FAQs) concerning the drug, and complete product identification information. Up-and-down directional arrows may be provided to the right of this screen to allow a user to scroll through the previously mentioned display options. Centrally placed, a numeric keypad fashioned of a brushed steel may be offered for input options; conveniently, these numbers may feature raised Braille protrusions for the visually impaired.

On the far right of the front panel of this embodiment may be a key component of the D4's control system. This component may be rendered in the form of a biometric finger scanner that must be used in conjunction with the keypad in order to dispense the product. This scanner may be augmented with a tamper-proof steel collar that is laid flush with the rest of the unit body. The internal components of the D4 may contain an array of useful and protective features. The medications themselves may be installed within the unit via a rectangular hopper that may be able to house a cartridge of vertically stacked pills (numbering about 140 for a single-depth cartridge/180 for a double). The hopper in which these cartridges may be placed may be surrounded by a strong, yet breakable, glass casing. Surrounding the perimeter of this glass, a channel containing a specially formulated, opiate-canceling liquid substance may be included. This "fail-safe" may serve to pour directly into the hopper, ruining the medication in case the D4 is tampered with or otherwise abused. This product may also feature an automatic notification system to warn a pharmacist, as well as law enforcement, that the unit has been compromised.

The D4 Dvorak's Drug Dispensing Device may help ensure that addictive prescription drugs are not abused by either patients or others with illegal intent. An automated, programmable unit specifically configured to lock in and correctly administer only prescribed dosages of powerful medication, especially narcotics such as OxyContin/Oxycodone; the D4 may only allow the amount of pills, at the designated times, to be released from the system, thanks to specific programming initiated by trained, ethical pharmacists. In this manner, the user of the drug may only be able to treat their illness as the doctor intends, without the chance that he or she may accidentally, or intentionally, take more than needed. As such, the D4 may help significantly reduce overdoses from prescription drug abuse, not to mention the steady increases in the abuse itself.

The present system may also prevent unauthorized users from accessing the medications kept inside. Should one try to break open the unit, the opiate-destroying chemical inside may thwart any ideas about selling the pills on the street. The D4 Dvorak's Drug Dispensing Device may thus help those who need the medications, and are not prone to abuse, to benefit from full-strength treatment, without having to rely on reduced-power alternatives offered by pharmaceutical companies in their efforts to curtail abuse.

The D4 Dvorak's Drug Dispensing Device may prove an essential tool in the battle against prescription drug abuse while making it possible to keep these drugs on the market. Outfitted with a wide array of controlled features, this unit may provide an essential addition to the medical supplies market.

In alternative embodiments, the present invention may comprise an electronically controlled monitoring and dispensing device specially designed for use with prescription medications, particularly the powerful, addictive substances such as those mentioned above. The drug dispensing/monitoring device is presented as a multifaceted unit that is distributed by pharmacies that are charged with filling the prescriptions for these medications; as such, the unit may serve as an intricately guarded casing that can only dispense the preprogrammed dosage amounts at the preset times, as directed by the prescribing physician.

Thus constructed, use of the drug dispensing/monitoring device may be fairly simple and straightforward. A patient may take a prescription to the pharmacy; the pharmacist may then utilize the drug dispensing/monitoring device to fill the amount of pills indicated by placing them inside the unit's hopper. The pharmacist may then program the system according to prescription information, and store the patient's scanned fingerprint into the unit. In this manner, only the print recognition technology may be able to activate the dispenser, and then only at the pre-set time and the dosage amount input into the system. The user may need to place the finger on the scanner at the right time, and the drug dispensing/monitoring device may only dispense one pill. As mentioned previously, any tampering with the product to access more medications or to deviate from the programming may result in the drug-destroying liquid filling the drug dispensing/monitoring device hopper, ruining all remaining pills for consumption and thus rendering them completely useless for intake or resell.

It should be noted that the steps described in the method of use can be carried out in many different orders according to user preference. The use of "step of" should not be interpreted as "step for", in the claims herein and is not intended to invoke the provisions of 35 U.S.C. §112, ¶6.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A prescription medication security and dispensing system comprising:

a device-housing;

a prescription medication delivery assembly comprising;

a carousel comprising;

a base-plate having a plurality of base-plate openings;

a top-plate having a plurality of top-plate openings;

a center rod;

a crank;

an electric motor; and a carousel power-supplier;

a plurality of pill-retaining cylindrical compartments;

a delivery chute;

a delivery door;

a programmable interface comprising;

a microcontroller;

a wireless transmitter and transceiver unit;

a memory device;

a user-inputter; and a power source;

at least one tamper-detecting sensor; and a pill-dump funnel; and a prescription medication destruction unit comprising;

a medication destruction unit enclosure;

an oxidation chamber;

a destruction unit microprocessor;

a signal receiver; and a medication destruction power supplier;

wherein said device-housing, said prescription medication delivery assembly, and said prescription medication destruction unit comprises in functional combination said prescription medication security and dispensing system;

wherein said device-housing comprises a cylindrical profile and an inner volume;

wherein said device-housing comprises a top and a bottom;

wherein said inner volume of said device-housing is bifurcated into an upper-section and a lower-section;

wherein said prescription medication delivery assembly is integrally located inside said upper-section of said device-housing;

wherein said base-plate and said top-plate of said carousel each comprise a center hole;

wherein said plurality of base-plate openings and said plurality of top-plate openings are of equal dimension;

wherein said center rod transverses said center holes of said base-plate and said top-plate such that said base-plate and said top-plate are fixedly mounted to said center rod;

wherein said plurality of pill-retaining cylindrical compartments comprises removable capsules structured and arranged to fit within said plurality of base-plate openings of said base-plate and said plurality of top-plate openings of said top-plate;

wherein a bottom of said center rod is mounted to said crank, said crank turned by said electric motor, said electric motor powered by said carousel power-supplier;

wherein said plurality of pill-retaining cylindrical compartments are structured and arranged to store at least one prescription medication pill in a vertically stack;

wherein each of said plurality of pill-retaining cylindrical compartments comprises a manually-openable compartment-top;

wherein each of said plurality of pill-retaining cylindrical compartments comprises an electronic component, said electronic component structured and arranged to open a compartment-bottom, said electronic component in communication with said microcontroller of said programmable interface;

wherein said delivery chute is located underneath said base-plate of said carousel;

wherein a top-opening of said delivery-chute comprises a pill delivery point;

wherein said top-opening of said delivery-chute comprising said pill delivery point is in direct alignment underneath one of said plurality of openings of said base-plate;

wherein said delivery-chute comprises a slide connecting said pill delivery point to a pill delivery area, said pill delivery area located adjacent said delivery door;

wherein said delivery door comprises a delivery-door electronic component, said delivery-door electronic component in communication with said microcontroller of said programmable interface;

wherein said delivery-door comprises a locking mechanism controlled by said delivery-door electronic component;

wherein said power source provides operating power to said programmable interface;

wherein said microcontroller controls said programmable interface;

wherein said memory device comprises at least one data file, said at least one data file comprising prescription medication dispensing parameters for automatically dispensing said at least one prescription medication pill according to a prescription medication dosage schedule;

wherein said user-inputter is located on an outside of said device-housing;

wherein said programmable interface is structured and arranged to receive and execute data commands communicated to said microcontroller via said user-inputter for programming said prescription medication dosage schedule storable on said memory device;

wherein said at least one tamper-detecting sensor is structured and arranged to detect a tampering attempt by an unauthorized user;

wherein said at least one tamper-detecting sensor is structured and arranged to communicate a tamper-impulse signal to said microcontroller of said programmable interface;

wherein said microcontroller transmits said tamper-impulse signal to said electronic component of each of said plurality of pill-retaining cylindrical compartments upon a detection of said tamper-impulse;

wherein said electronic component causes said compartment-bottom to swing open upon detection of said tamper-impulse signal;

wherein said prescription medication destruction unit is integrally located inside said lower-section of said device-housing;

wherein said pill-dump funnel is located between said prescription medication destruction unit and said prescription medication delivery assembly;

wherein said oxidation chamber, said destruction unit microprocessor, said signal receiver, and said medication destruction power supplier are fixedly mounted inside said medication destruction unit enclosure;

wherein said pill-dump funnel comprises a large bottom opening communicating downwardly into said oxidation chamber of said prescription medication destruction unit via an electronically-openable-entry of said medication destruction unit enclosure;

wherein said oxidation chamber, said destruction unit microprocessor, and said signal receiver are powered by said medication destruction power supplier;

wherein said oxidation chamber is structured and arranged to oxidize said at least one prescription medication pill;

wherein said prescription medication security and dispensing system is structured and arranged to deliver an entirety of said at least one prescription medication pill(s) contained within each of said pill-retaining cylindrical compartments to said oxidation chamber for destruction upon a detection of said tamper-impulse signal transmitted to said signal receiver of said prescription medication destruction unit from said microcontroller of said programmable interface; and wherein said prescription medication security and dispensing system is useful to automatically dispense a prescription medication dosage to a user according to said prescription medication dosage while also preventing an unauthorized person from accessing said at least one prescription medication pill by automatically destroying said at least one prescription medication pill upon detection of said tamper-attempt by said at least one tamper-detecting sensor.

2. The prescription medication security and dispensing system of claim 1 wherein said prescription medication destruction unit further comprises a dual-blade fan powered by a small induction motor and mounted to a bottom-opening of said pill-dump funnel for pulverizing said at least one prescription medication pill passing there-through into said oxidation chamber.

3. The prescription medication security and dispensing system of claim 2 wherein said oxidation chamber comprises at least one chemical-retaining-reagent for retaining at least one chemical agent useful for destroying said at least one prescription medication pill.

4. The prescription medication security and dispensing system of claim 3 wherein said at least one chemical-retaining-reagent is structured and arranged to open and close to release a mixable-quantity of said at least one chemical agent into said oxidation chamber upon receipt of said tamper-impulse signal by said signal receiver of said prescription medication destruction unit such that said at least one chemical agent(s) are sufficiently mixed within said oxidation chamber.

5. The prescription medication security and dispensing system of claim 4 wherein said destruction unit microprocessor controls a volume of said mixable-quantity of said at least one chemical agent to be released into said oxidation chamber according to a quantity and an identity of said at least one prescription medication pill being destroyed in said oxidation chamber.

6. The prescription medication security and dispensing system of claim 5 wherein said at least one chemical agent retained in said at least one chemical-retaining-reagent comprises hydrogen peroxide useful for a first-oxidation means for destroying said at least one prescription medication pill.

7. The prescription medication security and dispensing system of claim 6 wherein said at least one chemical agent retained in said at least one chemical-retaining-reagent comprises a quantity of acidified ferrous sulfate useful for said first-oxidation means for destroying said at least one prescription medication pill.

8. The prescription medication security and dispensing system of claim 7 wherein said at least one chemical agent retained in said at least one chemical-retaining-reagent comprises a quantity of potassium permanganate useful for a second-oxidation means for destroying said at least one prescription medication pill.

9. The prescription medication security and dispensing system of claim 8 wherein said at least one chemical agent retained in said at least one chemical-retaining-reagent comprises a quantity of sodium hydroxide useful for said second-oxidation means for destroying said at least one prescription medication pill.

10. The prescription medication security and dispensing system of claim 9 wherein said medication destruction unit enclosure comprises thermal insulation to prevent excess environment heating caused by exothermic decomposition.

11. The prescription medication security and dispensing system of claim 10 wherein said oxidation chamber comprises at least one vent to prevent pressure buildup from reaction product gases.

12. The prescription medication security and dispensing system of claim 11 wherein said user-inputter comprises a LCD touch screen display for user-input and information display.

13. The prescription medication security and dispensing system of claim 12 wherein said user-inputter is structured and arranged to accept an authorization key relating to said user that is authorized to access said prescription medication dosage pursuant to said prescription medication dosage schedule for said user.

14. The prescription medication security and dispensing system of claim 13 wherein said locking mechanism of said delivery door is temporarily unlocked upon receipt of said authorization key for allowing said user that is authorized to access said at least one prescription medication pill.

15. The prescription medication security and dispensing system of claim 14 wherein said authorization key comprises a numerical security code.

16. The prescription medication security and dispensing system of claim 15 wherein said user-inputter further comprises a biometric finger scanner for scanning and reading at least one fingerprint of said user that is authorized, said at least one fingerprint comprising said authorization key.

17. The prescription medication security and dispensing system of claim 16 wherein said top comprises a device-door, said device-door lockable via a device-lock and openable via a device-key.

18. A prescription medication security and dispensing system comprising:

a device-housing;

a prescription medication delivery assembly comprising;

a carousel comprising;

a base-plate having a plurality of base-plate openings;

a top-plate having a plurality of top-plate openings;

a center rod;

a crank;

an electric motor; and a carousel power-supplier;

a plurality of pill-retaining cylindrical compartments;

a delivery chute;

a delivery door;

a programmable interface comprising;

a microcontroller;

a wireless transmitter and transceiver unit;

a memory device;

a user-inputter, said user-inputter comprising a LCD touch screen display, said user-inputter structured and arranged to accept an authorization key, said authorization key comprising a numerical security code;

a biometric finger scanner for scanning and reading at least one fingerprint; and a power source;

at least one tamper-detecting sensor; and a pill-dump funnel; and a prescription medication destruction unit comprising;

a medication destruction unit enclosure, said medication destruction unit enclosure comprising thermal insulation;

a dual-blade fan, said dual-blade fan powered by a small induction motor, said dual-blade fan mounted to a bottom-opening of said pill-dump funnel;

a vitrification chamber, said vitrification chamber comprising at least one chemical-retaining-reagent for retaining at least one chemical agent, said at least one chemical-retaining-reagent structured and arranged to open and close to release a mixable-quantity of said at least one chemical agent, said vitrification chamber further comprising at least one vent to prevent pressure buildup from reaction product gases;

a destruction unit microprocessor, said microprocessor structured to control a volume of said mixable-quantity of said at least one chemical agent to be released into said vitrification chamber according to a quantity and an identity of at least one prescription medication pill being destroyed in said vitrification chamber;

a signal receiver; and a medication destruction power supplier;

wherein said device-housing, said prescription medication delivery assembly, and said prescription medication destruction unit comprises in functional combination said prescription medication security and dispensing system;

wherein said device-housing comprises an inner volume;

wherein said device-housing comprises a top and a bottom, said top comprising a device-door, said device-door lockable via a device-lock and openable via a device-key;

wherein said inner volume of said device-housing is bifurcated into an upper-section and a lower-section;

wherein said prescription medication delivery assembly is integrally located inside said upper-section of said device-housing;

wherein said base-plate and said top-plate of said carousel each comprise a center hole;

wherein said plurality of base-plate openings and said plurality of top-plate openings are of equal dimension;

wherein said center rod transverses said center holes of said base-plate and said top-plate such that said base-plate and said top-plate are fixedly mounted to said center rod;

wherein said plurality of pill-retaining cylindrical compartments comprises removable capsules structured and arranged to fit within said plurality of base-plate openings of said base-plate and said plurality of top-plate openings of said top-plate;

wherein a bottom of said center rod is mounted to said crank, said crank turned by said electric motor, said electric motor powered by said carousel power-supplier;

wherein said plurality of pill-retaining cylindrical compartments are structured and arranged to store at least one prescription medication pill in a vertically stack;

wherein each of said plurality of pill-retaining cylindrical compartments comprises a manually-openable compartment-top;

wherein each of said plurality of pill-retaining cylindrical compartments comprises an electronic component, said electronic component structured and arranged to open a compartment-bottom, said electronic component in communication with said microcontroller of said programmable interface;

wherein said delivery chute is located underneath said base-plate of said carousel;

wherein a top-opening of said delivery-chute comprises a pill delivery point;

wherein said top-opening of said delivery-chute comprising said pill delivery point is in direct alignment underneath one of said plurality of openings of said base-plate;

wherein said delivery-chute comprises a slide connecting said pill delivery point to a pill delivery area, said pill delivery area located adjacent said delivery door;

wherein said delivery door comprises a delivery-door electronic component, said delivery-door electronic component in communication with said microcontroller of said programmable interface;

wherein said delivery-door comprises a locking mechanism controlled by said delivery-door electronic component;

wherein said locking mechanism of said delivery door is temporarily unlocked upon receipt of said authorization key by said user-inputter;

wherein said power source provides operating power to said programmable interface;

wherein said microcontroller controls said programmable interface;

wherein said memory device comprises at least one data file, said at least one data file comprising prescription medication dispensing parameters for automatically dispensing said at least one prescription medication pill according to a prescription wherein said user-inputter is located on an outside of said device-housing;

wherein said programmable interface is structured and arranged to receive and execute data commands communicated to said microcontroller via said user-inputter for programming said prescription medication dosage schedule storable on said memory device;

wherein said at least one tamper-detecting sensor is structured and arranged to detect a tampering attempt by an unauthorized user;

wherein said at least one tamper-detecting sensor is structured and arranged to communicate a tamper-impulse signal to said microcontroller of said programmable interface;

wherein said microcontroller transmits said tamper-impulse signal to said electronic component of each of said plurality of pill-retaining cylindrical compartments upon a detection of said tamper-impulse;

wherein said electronic component causes said compartment-bottom to swing open upon detection of said tamper-impulse signal;

wherein said prescription medication destruction unit is integrally located inside said lower-section of said device-housing;

wherein said pill-dump funnel is located between said prescription medication destruction unit and said prescription medication delivery assembly;

wherein said vitrification chamber, said destruction unit microprocessor, said signal receiver, and said medication destruction power supplier are fixedly mounted inside said medication destruction unit enclosure;

wherein said pill-dump funnel comprises a large bottom opening communicating downwardly into said vitrification chamber of said prescription medication destruction unit via an electronically-openable-entry of said medication destruction unit enclosure;

wherein said vitrification chamber, said destruction unit microprocessor, and said signal receiver are powered by said medication destruction power supplier;

wherein said vitrification chamber is structured and arranged to vitrify said at least one prescription medication pill;

wherein said prescription medication security and dispensing system is structured and arranged to deliver an entirety of said at least one prescription medication pill(s) contained within each of said pill-retaining cylindrical compartments to said vitrification chamber for destruction upon a detection of said tamper-impulse signal transmitted to said signal receiver of said prescription medication destruction unit from said microcontroller of said programmable interface; and wherein said prescription medication security and dispensing system is useful to automatically dispense a prescription medication dosage to a user according to said prescription medication dosage while also preventing an unauthorized person from accessing said at least one prescription medication pill by automatically destroying said at least one prescription medication pill upon detection of said tamper-attempt by said at least one tamper-detecting sensor.

19. The prescription medication security and dispensing system of claim 18 wherein said at least one chemical agent comprises rapid cure epoxy for solidifying and encapsulating said at least one prescription medication pill after pulverization by said dual-blade fan.

* * * * *